United States Patent [19]

Olson

[11] 3,975,844

[45] Aug. 24, 1976

[54] DIGGER TOOTH MEANS FOR FRONT LOADER BUCKETS

[76] Inventor: Rueben C. Olson, 6211 Mahogany Ave., Westminster, Calif. 92683

[22] Filed: Nov. 10, 1975

[21] Appl. No.: 630,701

[52] U.S. Cl. ..... 37/117.5; 37/141 R; 37/DIG. 3; 214/145

[51] Int. Cl.[2] ..... E02F 3/76

[58] Field of Search ..... 37/117.5, 103, DIG. 3, 37/141 R; 214/131 R, 145 R, 138 R, 140, 141, 510

[56] References Cited

UNITED STATES PATENTS

| | | | |
|---|---|---|---|
| 3,014,606 | 12/1961 | Kampert et al. | 214/145 |
| 3,033,395 | 5/1962 | Lowery | 214/145 X |
| 3,057,496 | 10/1962 | Garske | 214/145 X |
| 3,065,870 | 11/1962 | Granryd et al. | 214/145 X |
| 3,243,067 | 3/1966 | Artman | 37/117.5 X |
| 3,738,030 | 6/1973 | Olinger | 37/117.5 |
| 3,795,070 | 3/1974 | Bronson et al. | 37/117.5 |
| 3,854,607 | 12/1974 | Kamner | 214/140 |
| 3,854,608 | 12/1974 | Arnold | 37/117.5 X |
| 3,915,501 | 10/1975 | Cobb et al. | 37/117.5 X |

*Primary Examiner*—E. H. Eickholt
*Attorney, Agent, or Firm*—Georges A. Maxwell

[57] ABSTRACT

In combination with a normally forwardly opening excavating bucket with a lower, forwardly projecting laterally extending earth engaging lip, an elongate bar normally engaged adjacent the lip and having a plurality of laterally spaced forwardly projecting digger teeth, elevator arms fixed to and normally extending rearwardly from the ends of the bar laterally outward of the bucket, a transversely extending shaft rearward of the bucket and fixed to the rear ends of the arms, bearing means on the bucket to shiftably and rotatably support the shaft, a lever arm projecting radially from the axis of the shaft and a cylinder and ram unit fixed to and extending between the bucket and the shaft and operable to shift the shaft and the bar forwardly and rearwardly out of and into adjacent engagement with the lip and to rotate the shaft and pivot the bar substantially vertically into and out of normal engagement with said lip.

6 Claims, 6 Drawing Figures

Fig. 1.
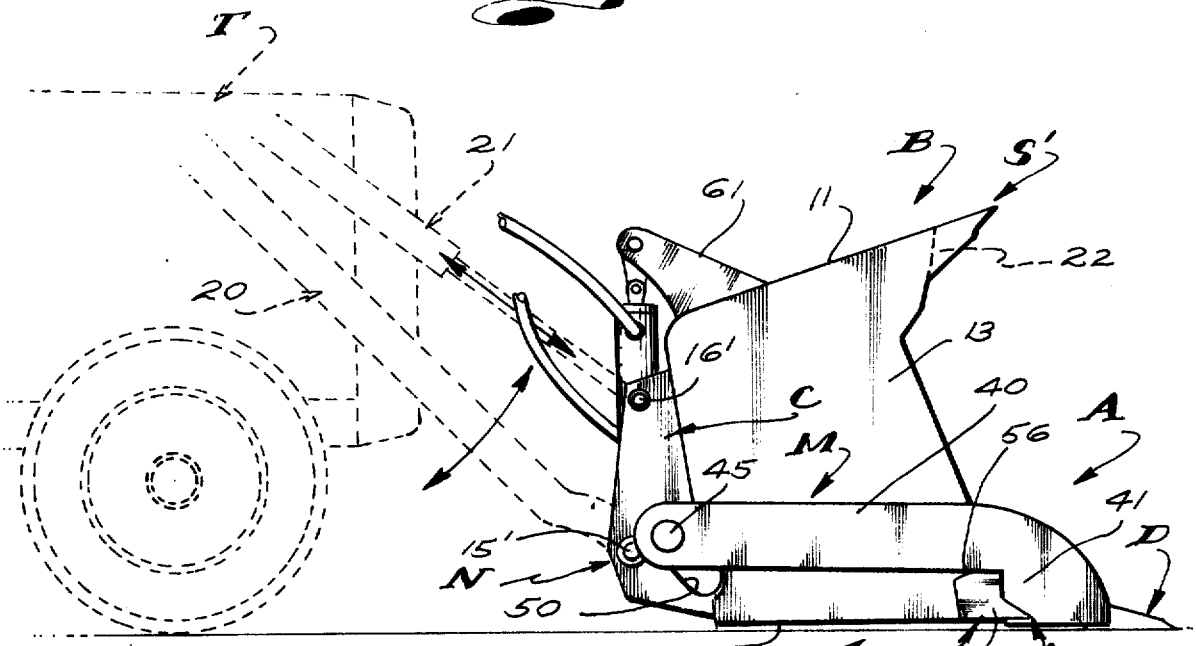
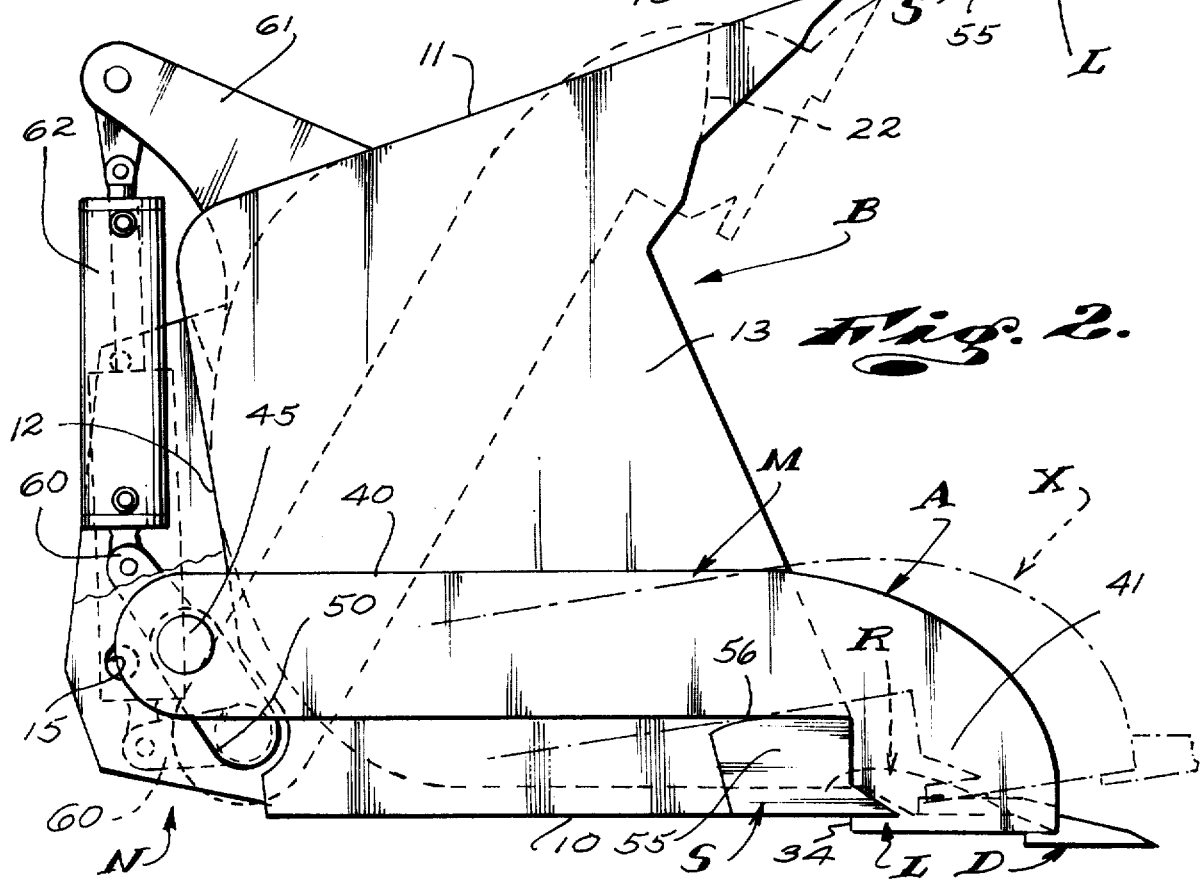
Fig. 2.

DIGGER TOOTH MEANS FOR FRONT LOADER BUCKETS

This invention has to do with an excavating bucket and is more particularly concerned with an improved bucket structure for use in combination with wheeled and track laying tractors and the like and which is characterized by a tooth carrying ripper bar which is selectively shiftable into and out of cooperative relationship with a straight earth engaging edge of the bucket.

The ordinary excavating bucket of the general character referred to above is characterized by the normally flat, horizontal bottom wall with a straight transverse, forward, earth engaging edge or lip, a rear wall extending upwardly from the rear of the bottom wall, a top wall extending or continuing forwardly from the upper end of the rear wall to occur in spaced relationship above the bottom wall and terminating at a front transversely extending lip or edge and flat, laterally spaced, verticall side walls joined with and extending between the sides of the bottom, rear and top walls.

In normal practice and construction, the lower rear portions of the rear walls of such buckets are pivotally connected with the forward ends of pairs of elongate, laterally spaced, parallel elevator arms which have rear ends pivotally connected to opposite sides of a related tractor and which project out substantially forwardly from the front end of the tractor. The elevator arms are pivoted upwardly and downwardly about their rear pivotal axes by manually controlled hydraulic cylinder and ram units and effect the raising and lowering of the buckets related to the front ends of said arms and relative to the tractors. Additionally, pairs of elongate, laterally spaced, parallel bucket tilting cylinder and ram units are pivotally connected with and extend between the upper portions of the rear walls of the buckets and the tractors in vertical spaced substantially parallel relationship with the elevator arms. The bucket tilting units are manually controlled and are operable to effect pivoting and/or tilting of the buckets relative to the front ends of the elevator arms and the tractors.

The above basic structure or combination and relationship of parts is old and is so familiar to those skilled or familiar with the art to which this invention pertains, that further detailed consideration thereof would only serve to burden this disclosure. Accordingly, further detailed consideration and/or reference to the bucket construction and its related tractor, elevator arms or means and the tilting units or means, will be suitably limited and/or restricted to that extent which is deemed necessary for adequate disclosure of the instant invention.

The lower forward earth engaging edges or lips of excavating buckets of the character here concerned with are normally straight, forwardly tapered and are effective to penetrate or dig into soft, loose earth and the like when they are properly disposed and urged forwardly, by their related tractors, into such earth and the like.

In many instances, where the materials to be excavated or worked upon with or by such buckets are hard and dense, the straight, lower forward earth engaging edges of the buckets cannot penetrate the materials. In such instances, it is common practice to apply and/or fix a plurality of elongate forwardly convergent, digger teeth to the said edges of the buckets, in lateral spaced relationship and so that they project freely forwardly therefrom. Such teeth, when thus related to the edges of the buckets, materially enhance the capability of the bucket structure to penetrate material worked upon. Such teeth also make possible the performing of other special work, such as scarifying the breaking up of the earth surface as for the purpose of performing grading or leveling operations and the like.

The ordinary digger tooth such as is used in the art here involved is an assembly including a tooth structure which must be well secured or fixed to the bucket as by means of a plurality of a nut and bolt assemblies or as by welding. The tooth assemblies further include a wear receiving tooth cap engaged on and about the tooth and releasably secured thereto by suitable fastening means.

In some instances, the provision and/or use of the above noted tooth caps is or can be dispensed with.

In either case, and as is well known in the art, the application and/or removal of digger teeth, as above noted, is a time consuming laborious and costly operation which cannot be practically or effectively carried out on an ongoing or regular basis. As a result of the above, as the general rule, where the need for both straight edge buckets and toothed edge buckets exist, two tractors, each with one of the two noted different forms of buckets, are provided and each is employed, for its special capabilities, when needed.

The above practice result in an extremely costly duplication of equipment and personnel. Further, it will be readily apparent that in those instances where there is but one bucket equipped tractor available having one of the two noted forms of buckets, its capabilities are limited to performing only those functions or services attainable with or by the form of bucket it is equipped with and work requiring the other form of bucket, cannot be performed.

As a result of the above, the art has long recognized the need for and has sought to provide practical means for the fast, effective and efficient conversion of the more basic straight edge form of bucket to a toothed edge form of bucket, whereby a single bucket equipped tractor can be and is possessed with the special capabilities of both noted forms of buckets, in a selective manner and with the expenditure of a minimum amount of time and work effort.

To the above end, the prior art has provided various means for shiftably relating digger teeth to buckets whereby the teeth can be selectively shifted into and out of working relationship with the normally straight lower earth engaging lips or edges of the buckets. To the best of my knowledge, the most effective means of the character referred to above and provided by the prior art have comprised elongate, horizontal bars with digger teeth fixed thereto and shiftably mounted to their related buckets for selective movement from an operating position where they extend transverse the buckets adjacent the earth engaging edges or lips thereof to a non-operating position where the toothed bars are spaced free and clear of the noted edges or lips of the buckets. In certain of the above noted means, the bars are carried by the front ends of elongate elevator arms having rear ends pivoted to the opposite sides of the buckets, rearward of the earth engaging edges or lips thereof, and such that the bars can be manually pivotally elevated and lowered between operating and non-operating positions relative to the earth engaging lips of the buckets, as desired or as circumstances require. While such means have proven to be reasonably effective, they are, due to their considerable weight, size and cumbersome design, difficult and time consuming to operate and generally require labor of at least two men for periods of time exceeding five minutes, to effect releasing, moving and properly securing the bars when shifted from one position to the other. Additionally, the above noted means can be quite costly to make and install and in some instances require undesirable re-working and/or modification of the buckets with which they are related.

In at least one toothed bar structure of the character referred to above and which is taught in the prior art, the bar is provided with a rearwardly opening V-groove or channel in which the tapered earth engaging edge of a related bucket is wedgingly engaged when the bar is in operating position and which is intended to securely maintain the bar in working position, when in use. While such a means would appear to be effective and desirable, it has been found to be wanting due to the tendency for dirt to accumulate and become compacted in the channel and about the lip in such a manner as to make disengagement of the bar from its related lip of the bucket and in some cases engagement of the bar with said lip of the bucket, extremely difficult. Further, the presence and compaction of the dirt in said channels tend to result in premature wear of the construction and frequently results in adverse deformation of the structure.

An object and feature of my invention is to provide an improved and novel toothed bar attachment for excavating buckets of the general class and type referred to above. It is another object and feature of my invention to provide an attachment of the general character referred to which includes a cylinder and ram unit to selectively shift the bar to and from operating and non-operating positions relative to the earth engaging lip of its related bucket.

It is an object of my invention to provide a structure of the character referred to above wherein said cylinder and ram unit is effective to shift the bar between its said operating and non-operating positions in a small fraction of a minute and a structure wherein said cylinder and ram unit can be effectively and conveniently controlled by means of a manually operable valve remote from the attachment and in convenient access at the operator's or driver's station of the related tractor.

It is a further object and feature of my invention to provide an attachment of the character referred to above including novel means releasably securing the bar in working position on and relative to the earth engaging lip of its related bucket, which means is not subject to becoming fouled and is less likely to become prematurely worn or deformed by the accumulation and/or compaction of dirt thereabout.

It is yet another object and feature of my invention to provide an attachment of the general character referred to above which is easy and economical to make and install on a bucket, an attachment which does not require undesirable and costly modification and/or rebuilding of a bucket with which it is related and an attachment which is rugged, durable, effective and dependable in operation.

The foregoing and other objects and features of my invention will be apparent and will be fully understood from the following detailed description of a typical preferred form and carrying out of my invention throughout which description reference is made to the accompanying drawings, in which:

FIG. 1 is a side elevational view of a bucket with my invention related thereto and showing portions of a related tractor in dotted lines;

FIG. 2 is an enlarged view of the structure shown in FIG. 1 with portions removed and with parts shown in different positions, in dotted lines;

Figures 3, 4, 5, 6:
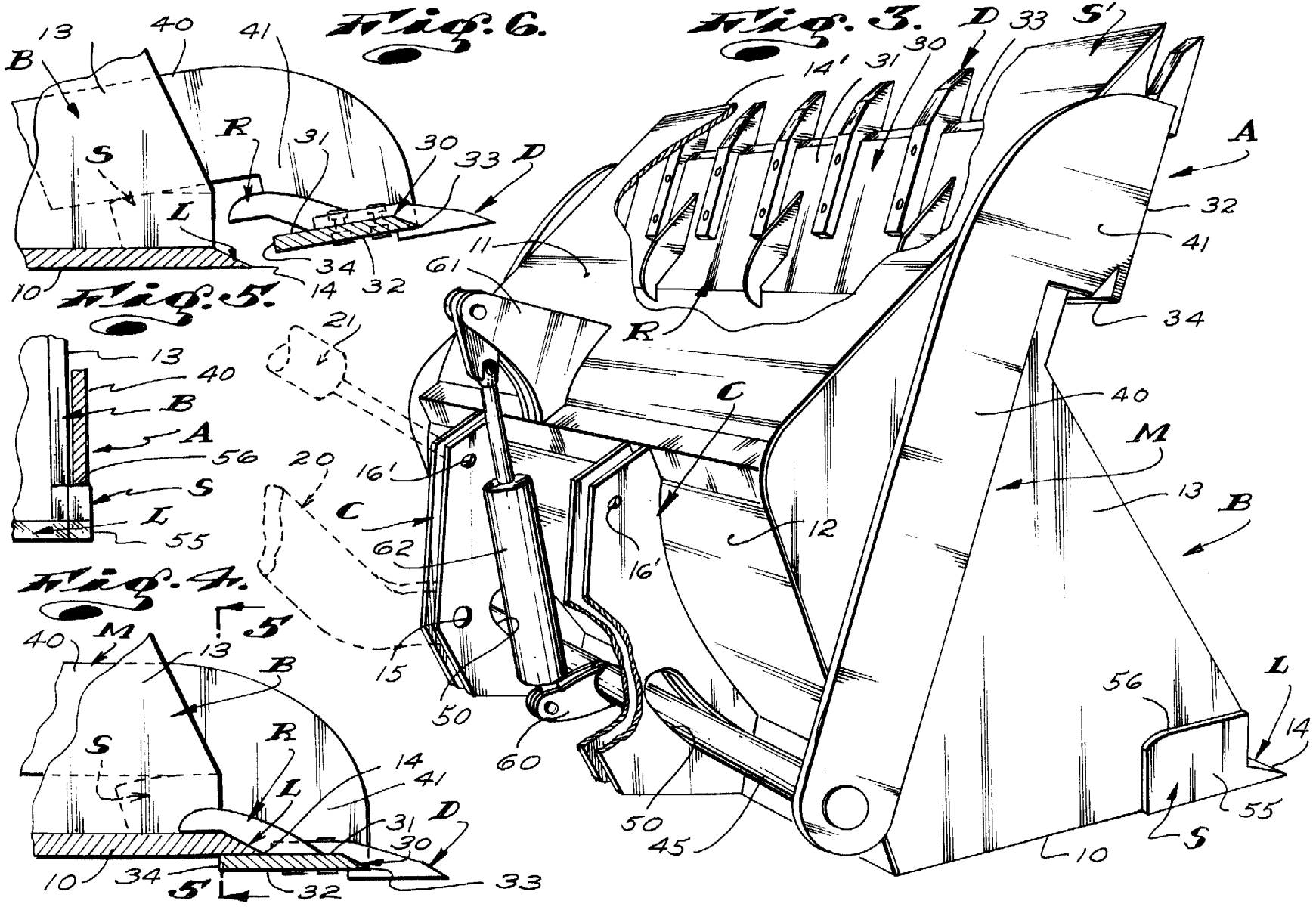
FIG. 3 is a perspective view of the structure having portions broken away to better illustrate the details of construction.
FIG. 4 is an enlarged detailed sectional view of a portion of the structure provided.
FIG. 5 is a sectional view taken as indicated by line 5—5 in FIG. 4.
FIG. 6 is a view similar to FIG. 4 showing parts in another position.

For the purpose of this disclosure, I have elected to illustrate a very common, widely used excavating bucket structure which structure or bucket is particularly suited to incorporate and/or have my attaching structure related to it.

The bucket B shown is that bucket structure manufactured by Ford Company of Romeo, Mich. and sold in connection and use with that company's various tractors.

The bucket B includes and/or is generally characterized by a normally flat, horizontally disposed bottom wall 10, a substantially flat substantially horizontal top wall 11 in vertical spaced and overlying relationship with the bottom wall 10, a normally substantially vertical rear wall 12 extending vertically between the rear ends or edge portions of the top and bottom walls and flat, vertical laterally spaced side walls 13 joining and extending between the side edges of the walls 10, 11 and 12, at opposite sides of the structure.

The bottom wall 10 defines and/or is provided with a forwardly disposed, straight, horizontal, transversely extending and forwardly convergent and forwardly projecting earth engaging lip L. The lip L defines the rather sharp forwardly disposed earth engaging edge 14.

The top wall 11 is provided with a similar lip or edge L'.

In addition to the foregoing, the bucket structure B is provided with a pair of laterally spaced, elongate, vertically extending and rearwardly opening clevis plates or units C fixed to and projecting rearwardly from the rear wall 12. Each clevis unit C is provided with vertically spaced pairs of sets of aligned, transversely opening draft or pivot pin receiving openings, there being lower pivot pin openings 15 and upper pivot pin openings 16.

In accordance with common practice, the bucket B is pivotally connected with or to the front ends of a pair of laterally spaced elongate elevator arms 20 projecting forwardly from the front end of a related tractor T. The arms 20 project forwardly from the tractor into the lower portion of the clevis units C on the bucket B and are pivotally connected therewith by pins 15' engaged in and through the openings 15 and the arms, as illustrated in the drawings. The other or rear ends of the arms 20 are suitably pivotally connected to the tractor (not shown) and have means, such as hydraulic cylinder and ram units (not shown) related thereto to effect vertical pivoting of the arms relative to the tractor and resulting raising and lowering of the bucket B.

Further, the bucket B is pivotally connected to or with the front ends of a pair of laterally spaced elongate tilting cylinder and ram units 21 which are operable to pivot or tilt the bucket B relative to the front ends of the elevator arms 20 and about the axes of the pins 15'. The rear ends of the cylinders of the units 21 are pivotally fixed to the tractor T in a suitable manner (not shown) and the front ends of the rams of said units 21 are engaged in the upper portions of the clevis units C on the bucket and are pivotally connected therewith by pivot pins 16', substantially as shown.

With the bucket structure set forth above and with the arms 20 and cylinder and ram units 21 related to it, it will be apparent that the bucket can be raised and lowered and can be tilted relative to the tractor as desired and as circumstances require.

In practice, in some bucket structures of the general character referred to above, separate clevis plates are provided for the arms 20 and units 21. In other bucket structures of the character referred to, a single unit 21, requiring a single clevis plate on the bucket, is not unusual.

In the particular bucket structure illustrated, the top wall 10 has been extended forwardly a limited distance for a reason which will be apparent and noted in the following:

The top and upper forward portion of the side walls of the bucket structure normally terminate at the dotted line 22 shown in FIGS. 1 and 2 of the drawings.

The attachment A that I provide includes an elongate, flat, normally horizontal plate-like bar with dtop and bottom surfaces 31 and 32, front and rear edges 33 and 34 and laterally outwardly disposed terminal ends. The bar is normally related or positioned adjacent the lip L of the bucket A on a plane below the plane of the bottom wall 10 of the bucket, with the rear portion of its top surface 31 in flat bearing engagement with the bottom surface of the lip and with its forward portion projecting freely forwardly from the bottom wall or lip of the bucket, as clearly illustrated in FIGS. 1, 2 and 4 of the drawings.

The bar 30 is provided with retaining means R to releasably maintain the bar in its above noted normal position with respect to the lip L. The means R is shown as including a plurality of laterally spaced upwardly and rearwardly extending lip engaging cleats 35. The cleats 35 are established of vertical disposed plate stock having forward portions fixed to the top surface 31 of the bar forward of the rear edge thereof and having upwardly and rearwardly extending rear portions with rearwardly and downwardly disposed edges which normally establish intimate bearing contact with the upwardly and forwardly disposed inclined surface of the forwardly tapered lip L and with the top surface of the bottom wall adjacent to the lip, as shown in FIG. 4 of the drawings.

The forward edge 33 of the bar 30 is suitably tapered, as shown.

The bar 30 next includes a plurality of elongate laterally spaced digger teeth D suitably fixed thereto to engage about the forward edge portion thereof and to project freely forwardly therefrom.

The teeth D can vary widely in construction and are preferably selected from one of the several commercially available tigger tooth constructions. Further, the teeth D can, if desired, be of a type and/or form which are not intended to have tooth caps related thereto or can be of a type and/or form with which tooth caps are intended to be related, as desired or as circumstances require. In the case illustrated, I have elected not to show caps related to the teeth D.

Since the particular tooth structure employed in carrying out my invention may vary widely and does not directly affect the novelty of my invention, I will not burden this disclosure with further detailed description of the particular tooth structures illustrated in the drawings.

The attachment A that I provide, in addition to the bar 30, retaining means R and digger teeth D, referred to above, includes carrier means M, operable to selectively shift the bar 30 to and from its noted down or normal working position to and up, non-working position where it is faced from and clear of the work-engaging lip L and where it occurs adjacent to the forward portion of the top wall 31 of the bucket, as clearly shown in FIG. 3 of the drawings and in dotted lines in FIG. 2 of the drawings.

The means M includes a pair of laterally spaced elongate, normally horizontally extending elevator arms 40 with front and rear ends, arranged adjacent the outer surfaces of the side wall 13 of the bucket. The front ends of the arms 40 have normally downwardly projecting extensions 41 which join and are fixed to adjacent outer terminal ends of the bar 30, as by welding.

The rear ends of the arms 40 project rearwardly from the rear wall 12 of the bucket at the opposite side of the bucket and are joined together by an elongate, horizontal, transversely extending pivot shaft 45. The shaft 45 is preferably established of cylindrical tube stock and is spaced clear of and extends transverse the rear portion of the rear wall 12 of the bucket.

It will be apparent that the shaft 45, arms 40 and bar 30 cooperate to establish a rigid, unitary rectangular frame-like structure engaged about and surrounding the bucket B.

The means M next includes laterally spaced bearing means N for the shaft, carried by the rear wall 12 of the bucket. The means N can be established by separate plate-like units fixed to the bucket or can, as illustrated, be established in and/or by the clevis units C of the bucket structure. The means N includes downwardly and forwardly inclined, laterally opening, elongate bearing slots 50, through which the shaft 45 projects and is slidably and pivotally supported.

The slots 50 are of such size and extent and are so positioned and/or disposed that when the arms 40 are down and horizontal and the shaft 45 is urged rearwardly and upwardly in the slots, the bar 30, at the front of the bucket, is urged rearwardly and snugly into its normal position with the lip L of the bucket. Further, the slots are such that when the shaft 45 is urged forwardly and downwardly in the slots 50, the bar 30 is urged and moved forwardly, out of engagement with and clear of the lip L of the bucket, as clearly illustrated in FIG. 6 of the drawings and as shown in dotted lines at X in FIG. 2 of the drawings. The means M next includes a lever arm 60 fixed to and projecting substantially rearwardly from the shaft 45, a mounting bracket 61 fixed to and projecting substantially rearwardly from the bucket 50 in spaced relationship above the lever arm 60, and a hydraulic cylinder and ram driver unit 62 suitably pivotally connected with and extending between the lever 60 and bracket 61. The unit 62 is selectively operable to raise and lower the shaft in the slots 50 and to rotate the shaft in the slots 50, as will hereinafter be described.

When the unit 62 is in its short or retracted position, it urges and holds the shaft 45 stopped in the upper rear ends of the slots 50 and in that position where the bar 30 and retaining means R are urged and maintained in their normal operating position with the lip L of the bucket. When the unit 62 is energized and/or operated to extend, it first urges the shaft forwardly and downwardly in the slots 50 with resulting forward movement and disengagement of the bar and retaining means with the lip L. When the shaft reaches and is stopped in the lower forward ends of the slots 50 and as the unit 62 continues to lengthen or extend, it rotates the shaft with resulting upward and rearward pivoting of the arm and shifting of the bar upwardly and rearwardly into its stopped, upper, non-operating position adjacent the forward portion of the top wall of the bucket. When the unit 62 is again operated or energized to retract or shorten, the shaft is first rotated to pivot the arms and move the bar from its noted up or non-operating position to a down position where the bar occurs forward of the lip L of the bucket. Following such pivoting of the shaft, and upon further retraction of the unit 62, the shaft is urged upwardly and rearwardly in the slots 50 and the bar is thereby shifted and urged rearwardly into normal operating position and engagement with the lip L.

In order for the above mechanical motion to be attained and to prevent the arms 40 and the bar 30 from being pivoted downwardly an excessive distance and in spaced relationship below the plane of the bottom wall 10 of the bucket, it is necessary that downward pivoting of the arm 40 be suitably limited. To this end, the structure A includes arm engaging stop means S at the opposite sides of the bucket and engaged by the arms 40 when the arms are pivoted forwardly and downwardly a desired and necessary extent and which serve to slidably support the arms when and as they are shifted rearwardly to move and urge the bar into normal operating engagement with the lip L, as noted above. In the case illustrated, the means S includes simple plates 55 fixed to the outer surfaces of the side walls 13 at the lower forward corner portions thereof and defining suitably formed and disposed stopped edges or surfaces 56, upon which the forward portions of the lower edges of the arms occurring rearward of the extension 41 on the arms, stop and are slidably supported.

In practice, upward and rearward movement of the bar can be limited by a second stop means at the side walls of the bucket, similar to the above noted stop means S. In the preferred carrying out of the invention, however, and as shown in the drawings, such movement of the bar is stopped by the top wall 11 of the bucket. To effect such stopping of the bar, it is necessary that the top wall of a standard bucket be extended, as shown in the drawings and as was noted in the preceding.

In light of the foregoing, it can be said that the extended forward portion of the top wall 11 of the bucket and defined by the dotted lines 22 in FIGS. 1 and 2 of the drawings, in an upper stop means. Accordingly, I will refer to and designate the forward portion of the top wall 11 of the bucket shown in the drawings as an upper stop means S'.

In addition to stopping the bar 30 in its up or non-working position, the forward portion of the top wall or stop means S' of the bucket also serves to effect positioning of the forward lip L' of the top wall structure of the bucket forward of the bar 30 and of the teeth D thereon so that the lip L' of the bucket can still be effectively used to perform grading or dragging work and the like when the bar is positioned and stopped against the top wall 11.

It will be apparent that the cylinder and ram unit 62 can be suitably provided with motive fluid from the same source of motive fluid which supplies fluid to the other hydraulic drive means of the related tractor T and can be controlled by any suitable and conveniently positioned manually operated valve (not shown).

It is believed to be readily apparent that the basic attachment structure illustrated and described above is extremely simple and such that with little adjustment and/or slight modification, it can be related to and/or combined with the overwhelming majority of commercially available excavation bucket structures of the general type and class here concerned with.

It is also believed to be apparent that the structure provided by my invention is inherently rugged, durable and dependable in operation and is such that the toothed bar can be effectively selectively moved into and out of working relationship with the earth engaging lip of the bucket in an extraordinary short period of tome and that the only physical work effort required to effect movement is the operation of that suitable manually operable control valve which is provided to operate the cylinder and ram unit 62.

Having described only a typical preferred form and application of my invention, I do not wish to be limited to the specific details herein set forth but wish to reserve to myself any modifications and/or variations that may appear to those skilled in the art and which fall within the scope of the following claims.

Having described my invention, I claim:

1. In combination, a normally forwardly opening excavating bucket with normally substantially horizontally disposed vertically spaced top and bottom walls, a vertically extending rear wall and vertical side walls, said bottom wall having a forwardly projecting forwardly disposed transverse earth-engaging lip, elevator and tipping means connected with the rear wall to raise and lower the bucket and to tip the bucket about a transverse axis, a digger tooth attachment comprising a transversely extending elongate bar normally in working position adjacent said lip and having a plurality of elongate laterally spaced digger teeth fixed thereto and projecting forwardly therefrom, elongate normally horizontally disposed elevator arms at the opposite sides of the bucket with forward ends fixed to related ends of said bar and rear ends fixed to the ends of an elongate transversely extending pivot shaft spaced rearward of the rear wall of the bucket, laterally spaced bearing means rotatably and shiftably support the shaft relative to the rear wall of the bucket, a lever arm on and projecting radially from the longitudinal axis of the shaft, a cylinder and ram drive unit fixed to and extending between the bucket and the lever arm selectively rotating and shifting the shaft to pivot the elevator arms and the bar between said normal working position and a non-working position where said bar is positioned adjacent the top wall of the bucket.

2. The structure set forth in claim 1 wherein said bar has a rear portion normally engaged beneath the lip and said structure includes retaining means on the bar and engaging said lip and releasably maintaining the bar in tight engagement with the lip.

3. The structure set forth in claim 2 wherein said retaining means includes laterally spaced cleats on the bar, normally projecting upwardly and rearwardly therefrom and in bearing engagement with and over said lip.

4. The structure set forth in claim 3 wherein said bearing means includes laterally spaced laterally opening forwardly and downwardly opening shaft receiving slots whereby said bar occurs forward of the lip when the shaft is in the lower forward end of the slots and occurs in normal position when the shaft occurs in the upper rear ends of the slots.

5. The structure set forth in claim 4 which further includes stop means normally engaging and limiting downwardly movement of the bar.

6. The structure set forth in claim 5 wherein said stop means includes stop plates at the sides of the bucket below and normally engaging and supporting the arms.

* * * * *